US006283619B1

(12) United States Patent
Pulaski et al.

(10) Patent No.: US 6,283,619 B1
(45) Date of Patent: Sep. 4, 2001

(54) LIGHTING FIXTURE ASSEMBLY HAVING LOCKING ARM COMPONENTS

(75) Inventors: Charles A. Pulaski, Southington; Stanley R. Otlowski, Andover, both of CT (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 09/572,686

(22) Filed: May 16, 2000

(51) Int. Cl.[7] ..... F21S 8/06
(52) U.S. Cl. ..... 362/405; 362/406
(58) Field of Search ..... 362/404, 405, 362/406

(56) References Cited

U.S. PATENT DOCUMENTS

| | | | | |
|---|---|---|---|---|
| 3,831,022 | * | 8/1974 | Porter et al. | 362/406 |
| 5,255,173 | * | 10/1993 | Schonbek | 362/406 |
| 5,258,900 | | 11/1993 | Bayer | 362/405 |
| 5,873,652 | | 2/1999 | Bayer et al. | 362/405 |

* cited by examiner

*Primary Examiner*—Stephen Husar
(74) *Attorney, Agent, or Firm*—Watts, Hoffmann, Fisher & Heinke, Co., L.P.A.

(57) ABSTRACT

A light fixture assembly having at least one arm that can be preassembled wherein the arm can be adjustably positioned to minimize packaging volume, and during installation, the arm can be adjustably positioned to lockingly engage a predetermined alignment position as specified by the manufacturer without any loss of structural integrity. The light fixture assembly includes a first plate having a central aperture and at least one peripheral opening, and a second plate removed from and fixedly positioned relative to the first plate. At least one arm is secured to the first plate wherein one end of the arm extends through the at least one peripheral opening. The second plate includes a central aperture and at least one independently flexible portion in contact with the arm end. A support rod extends through the central apertures of the first and second plates. The support rod is secured to the first plate. A notch on the end of the arm is adapted to lockingly receive the flexible portion of the second plate when the arm is rotated to a predetermined alignment position. A method of packaging and assembling the light fixture assembly includes preassembling the light fixture assembly by attaching and securing each arm to the peripheral apertures of the first plate, and attaching and securing a support rod to the central apertures of the first and second plates. The arms are then rotated and oriented to a position wherein storage volume is minimized, i.e., for packaging. For assembly and installation, the arms are rotated to an alignment position wherein the notched portion of the arm end lockingly engages with the flexible nub portion of the second plate.

19 Claims, 5 Drawing Sheets

LIGHTING FIXTURE ASSEMBLY HAVING LOCKING ARM COMPONENTS

FIELD OF INVENTION

The present invention relates to lighting fixture assemblies having a base portion and at least one arm extending from the base portion. In particular, the arms of the lighting fixture assembly are rotated to minimize packaging volume and upon installation, the arms are rotated to lockingly engage a predetermined alignment position.

BACKGROUND OF THE INVENTION

Light fixtures come in a wide variety of forms and are made from many different materials. For instance, a common light fixture is a fixture having a plurality of arms extending from a base portion. Typically, the base portion is centrally located with respect to the arms. An example of such a light fixture is shown in FIGS. 1 and 3.

The illustrated light fixture assembly, generally designated by reference numeral 10, comprises a number of common elements. The base portion 12 includes a conventional mounting plate 14 for securing the arms 16 to the base portion. The generally planar mounting plate includes a central aperture and a number of peripheral openings (not shown). A decorative base plate or dish 18 with similar openings and central aperture is used to conceal the mounting plate 14. The mounting plate and decorative base plate may be integrated into one piece. The assembly requires the openings and aperture of the plates to be axially aligned for attaching the respective arms 16 and a support rod 20. The number of plate openings generally correspond to the number of arms 16 included in the light fixture assembly. The central apertures are configured to receive the support rod 20. The support rod is typically made of a metal. A cap nut 22 is fastened to an end of the support rod and serves as a stop to provide the support means for attaching the light fixture assembly to an electrical box in a ceiling or the like. The arm 16 has one end 26 inserted and secured to the plate openings whereas the other end 28 is connected to a conventional lamp fixture assembly 30. Each arm end 26 includes an outward protrusion 46 distally spaced from arm end 26 to serve as a stop to axially position the arm 16 with respect to the plates. Electrical wiring extends from the light socket 30 through the arm 16 to the base portion 12 for electrically connecting the light socket to a power source. The arms 16 and support rod 20 are generally fastened to the mounting plate 14 by means of a single nut 32, and 34 respectively, and washer 36.

If the lighting fixture is assembled and packaged with the arms in its intended in-use position, the light fixture assembly could potentially take up a large area depending on the design of the light fixture. Consequently, fully assembled light fixtures will undesirably take up a disproportionate amount of storage and packaging space. Since there are a large variety of light fixtures available, it is preferred for the manufacturer, distributor, vendor or the like to minimize the packaging volume occupied by the light fixture assemblies so as to maximize the available storage space.

Manufacturers frequently preassemble the light fixture assemblies so as to minimize the overall space occupied by the light fixture. In particular, manufacturers rotate and orient the arms of the light fixture to minimize packaging volume or alternatively, completely disconnect the arms and package the arms as separate parts. Thus, packaging volume is minimized and shelf storage of these types of light fixture assemblies are maximized. However, the end user or installer of these preassembled light fixture assemblies is faced with the burden of completing the assembly. The end user or installer must either rotate the arms to the proper alignment position or attach and align the arms upon installation.

It should be readily understood that the foregoing process for assembling a light fixture imposes a serious burden on the distributor or consumer. It is oftentimes difficult for the end user or installer to accurately determine the proper alignment position of each arm. Moreover, the subsequent movement to align the arm often causes the nut 32 securing the arm 16 to the mounting plate 14 to loosen. As discussed above, the prior art light fixture assemblies 10 utilize single nut 32 and washer 36 to secure each arm 16 to mounting plate 14. It has been found that rotating the arm causes the nut to loosen, which in turn causes a loss of structural integrity. Attempts by the manufacturer to pre-tighten nut 32 exactly so as to allow the arm to move a predetermined amount wherein the nut is fully tightened when the arm is in proper alignment have been unsuccessful. One reason complicating this approach is that the installer may initially turn the arm the wrong way or alternatively, during shipment the nut rotates to some extent wherein misalignment of the arms can occur during installation. Moreover, in the case where the arms are packaged separately, the installer may not have the requisite skill level to safely attach and align the arms as intended by the manufacturer.

SUMMARY OF THE INVENTION

The present invention is generally directed to a light fixture assembly that can be preassembled by a manufacturer so as to minimize packaging volume and, upon installation, readily assembled as specified by the manufacturer without any loss of structural integrity. The present invention overcomes the prior art problems with lighting fixture assemblies having a base portion and at least one arm extending from the base portion. In particular, the arms of the lighting fixture assembly can be readily positioned to minimize packaging volume and, during installation, the arm can be readily positioned to lockingly engage a predetermined alignment position. Advantageously, the arms can be positioned without affecting the structural integrity of the light fixture assembly.

In general, the inventive light fixture assembly comprises a first plate having a central aperture and at least one peripheral opening, and a second plate removed from and fixedly positioned relative to the first plate. The second plate includes a central aperture and a number of independently flexible portions that are axially aligned with and correspond to each of the first plate openings. A support rod is secured to the central aperture of the first plate by at least one nut or other suitable fastener. One end of each arm is secured to the peripheral opening of the first plate and a threaded portion thereof extends partway through the opening. Preferably, each arm is secured to the first plate by at least two nuts. The central aperture of the second plate is aligned with and secured to the support rod wherein the independently flexible portions flex against corresponding arm ends. A notch on the end of each arm is adapted to lockingly receive the flexible portion when the arm is rotated to the predetermined alignment position.

A method of packaging and assembling the light fixture assembly having a plurality of arms includes inserting a threaded end of each arm into the peripheral opening of the first plate. At least two nuts are used to fasten the arms to the first plate. The arms can then be rotated to minimize packaging volume without loosening the connection of the arms to the first plate. A support rod is fastened to the central aperture of the first plate with at least one nut or other suitable fastener. The second plate is then inserted onto the support rod and the independently flexible portions are aligned with the arm ends. The second plate is fastened to the support rod with at least one nut or other suitable fastener. The flexible portion about each opening of the spring plate contacts and flexes against the arm end. During installation, each arm is rotated to a predetermined alignment position wherein a notch in each arm end lockingly receives the flexible portion of the second plate into the predetermined alignment position.

Other embodiments of the invention are contemplated to provide particular features and structural variants of the basic elements. The specific embodiments referred to as well as possible variations and the various features and advantages of the invention will become better understood from the accompanying drawings together with the detailed description that follows.

DETAILED DESCRIPTION OF THE PREFERRED EMBODIMENTS

The present invention is generally directed to light fixture assemblies wherein at least one arm extends from a base portion. The invention permits the light fixture assemblies to be preassembled so as to minimize packaging volume and, upon installation, readily assembled wherein the arms of the light fixture assemblies are easily rotated and locked into a predetermined alignment position without affecting structural integrity. Thus, the inventive light fixture assemblies overcome the problems associated with the prior art and provide an improved process for installing the light assemblies in the manner intended by the manufacturer without causing structural integrity problems; i.e., loosening of the arm connections to the base portion during installation.

Figure 1:
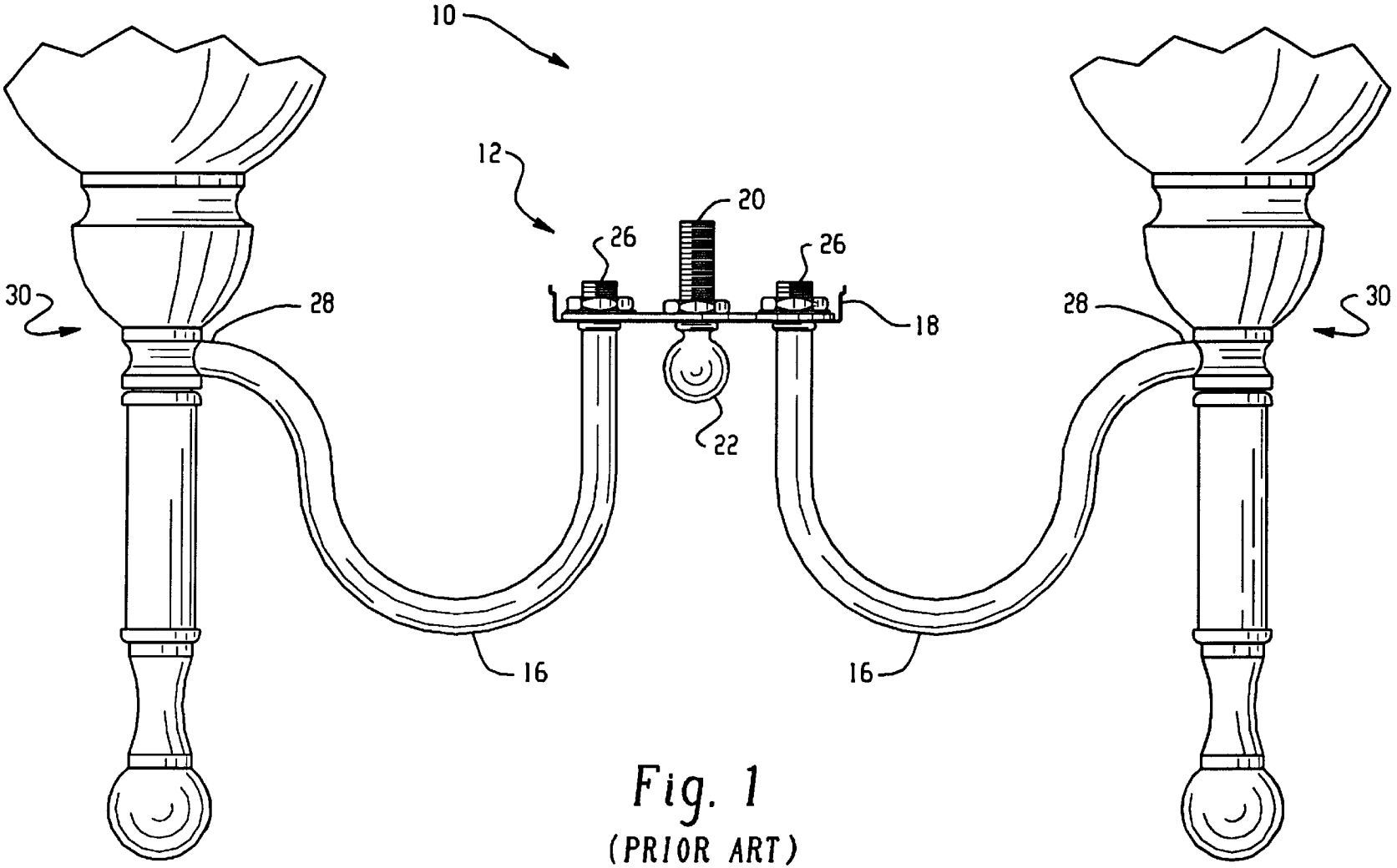
Fig. 1 (PRIOR ART)
FIG. 1 is a side plan view of a conventional light fixture assembly to which present invention can pertain.
Figure 2:
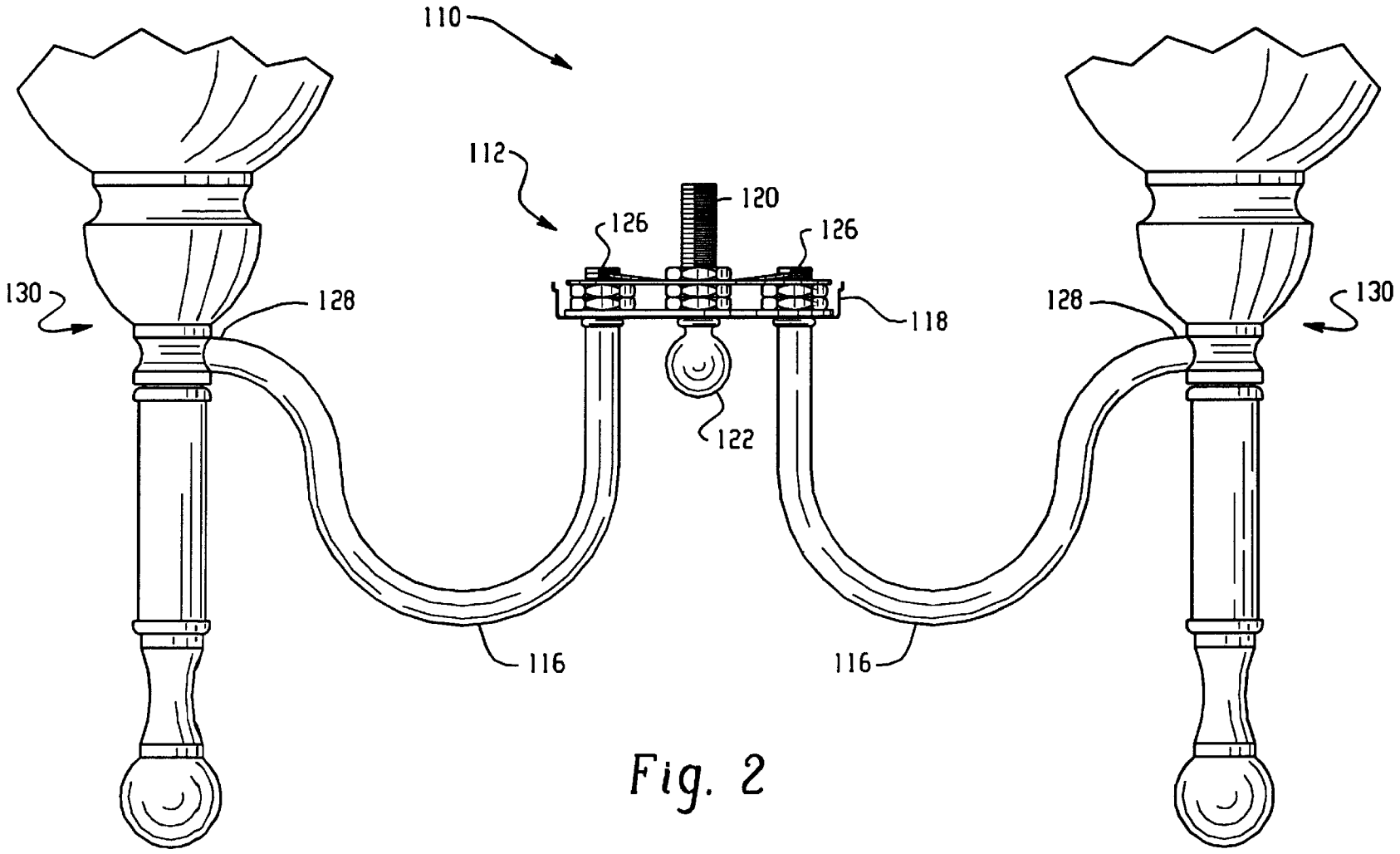
FIG. 2 is a side plan view of the inventive light fixture assembly constructed in accordance with one embodiment of the invention.
Figure 3:
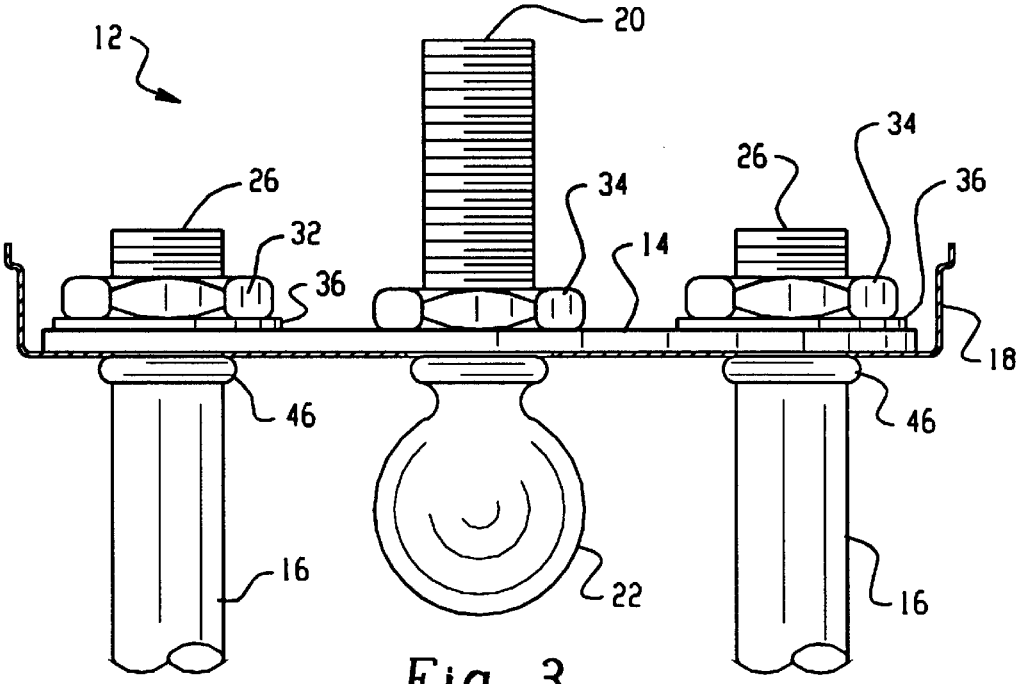
Fig. 3 (PRIOR ART)
FIG. 3 is an exploded side plan view of a conventional base portion of the type of light assembly depicted in FIG. 1.
Figure 4:
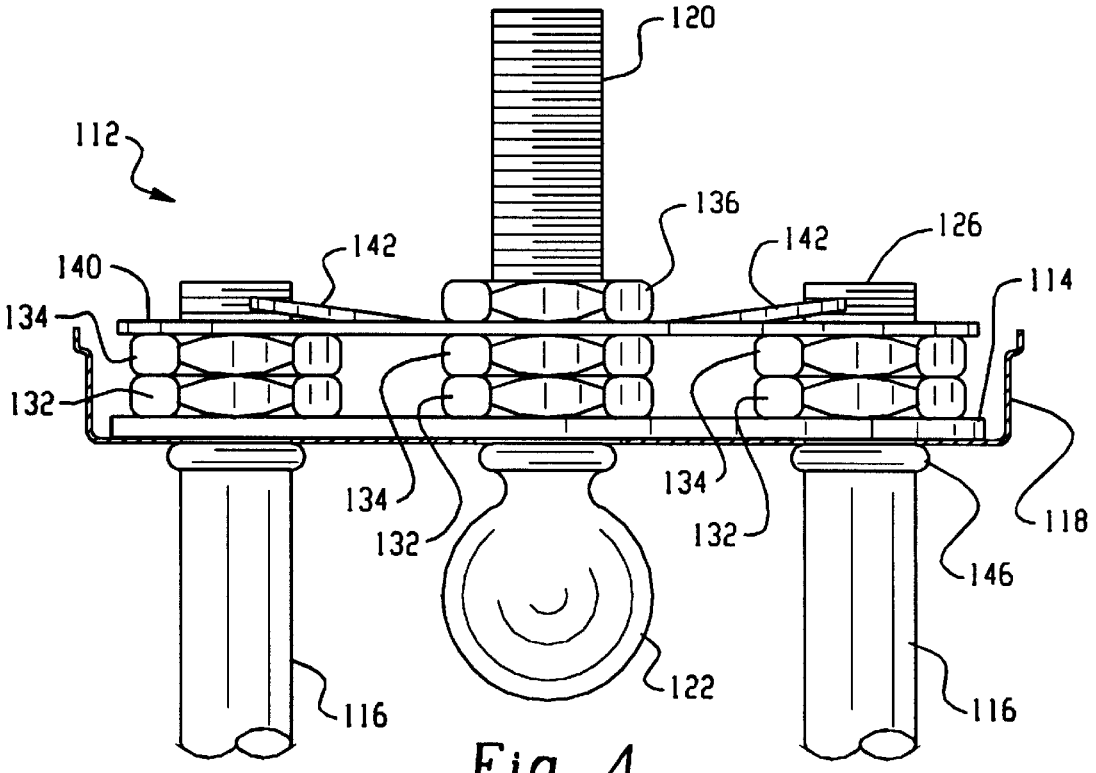
FIG. 4 is an exploded side plan view of the inventive base portion of the light assembly depicted in FIG. 2.
Figure 5:
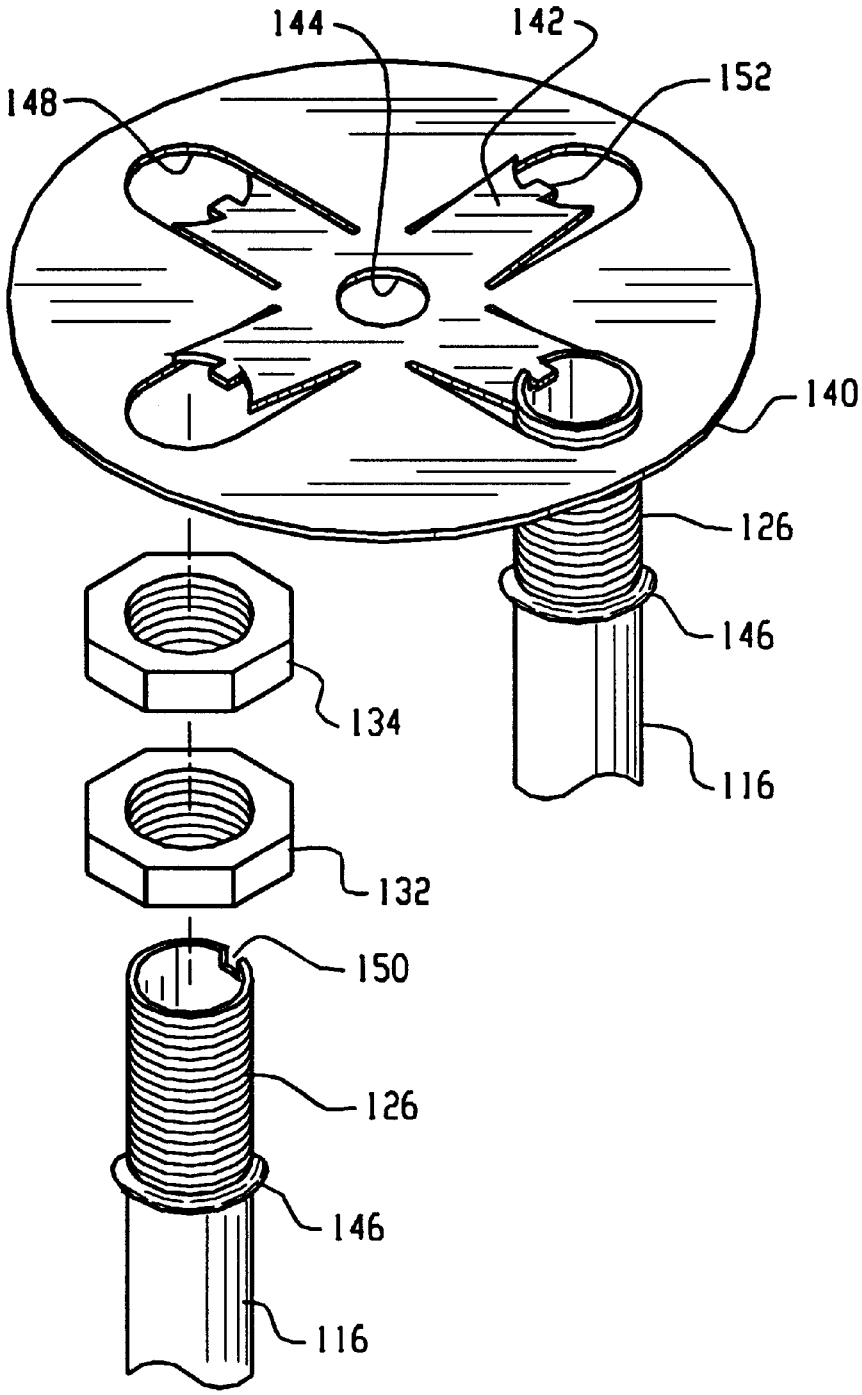
FIG. 5 is an exploded partial perspective view and partial perspective view of the base portion constructed in accordance with one embodiment of the invention.

Referring now to the FIGS. 2, 4 and 5, a inventive light fixture assembly is shown generally at 110. The light fixture assembly has a base portion 112 and at least one arm 116 extending from the base portion. For illustrative purposes, only two arms are depicted; additional arms typically are employed. Each arm 116 has one end 126 secured to the base portion whereas the other end 128 of the arm is connected to a lamp fixture 130. The lamp fixture includes a light socket (not shown) conventionally constructed. The arms 116 are shown as having an arcuate shape. It should be appreciated by those skilled in the art that other shapes are equally suitable. In addition, the arms need not extend vertically outward but may extend in virtually any direction. Electrical wire is connected to the lamp fixture 130 and a passageway in each arm directs electrical wire from the lamp fixture to the base portion 112 to permit connection to a power supply when the light fixture assembly 110 is installed.

The base portion 112 includes a mounting plate 114, a spring plate 140, and a support rod 120. A cap nut 122 is fastened to an end of the support rod and serves as a stop to provide the support means for installing the light fixture assembly to an electrical box in a ceiling, center column of a chain hung chandelier, center column of a table or floor base, or the like. Preferably, the base portion further includes a decorative plate or dish 118 that provides an aesthetically pleasing cover for the base portion from which the arms 116 visually extend from when installed. Plates 114, 118, and 140 are preferably made of a material that is of sufficient strength to withstand the forces exerted by the arms when the light fixture assembly is installed and the arms properly aligned. The material chosen for the plates should be a material that is readily machined so that openings may be cut in the plates. Suitable materials for the plates include steel, steel alloys, brass, chrome and the like. In addition, since the decorative plate 118 is typically non-functional, it may be made from a less rigid material such as a lightweight plastic. Alternatively, the decorative features of the decorative plate may integrated with the mounting plate.

All of the plates have a predetermined pattern of openings cut in them by conventional techniques. The number of plate openings generally correspond to the number of arms 116 included in the light fixture assembly. The configuration of each particular opening cut into the spring plate 140, however, differs from the configuration of each particular opening cut into the mounting and decorative plates, 114 and 118 respectively. As will be discussed in greater detail below, each opening 148 in the spring plate for receiving the arms includes a flexible portion 142 that defines the opening configuration of the spring plate. Nevertheless, it is preferred that there is one to one correspondence between each opening in the decorative, mounting and spring plates. As such, the openings for each plate can be axially aligned during assembly of the base portion.

Central apertures, like central aperture 144 of the spring plate shown in FIG. 5, is provided in each of plates 114, 118, and 140. The central apertures allow a support rod 120 to be attached to the plates. The support rod is typically manufactured from metal and is conventionally used as the means for attaching the light fixture assembly to a ceiling box, center column of a chain hung chandelier, center column of a table or floor base, or the like. A cap nut 122 is threaded onto one end of the support rod and serves as a stop so that the decorative plate 118 and mounting plate 114 can be secured with nuts 132 and 134. The support rod is exteriorly threaded and secured to a corresponding aperture in the ceiling box or the like. In a preferred embodiment, at least one nut 132 is used to secure the support rod to the decorative and mounting plates. Optionally, as shown, the support rod can be secured to the decorative and mounting plates by the same amount of nuts having similar dimensions as the arm ends. The openings are aligned in the decorative and mounting plates prior to fully tightening the nuts.

Each arm 116 has one end 126 inserted through the aligned openings provided in the decorative and mounting plates. Each arm end 126 includes an outward protrusion 146 distally spaced from the end to serve as a stop to axially position the arm 116 with respect to the plates. The arm end is exteriorly threaded and adapted to receive nuts 132 and 134. Nut 132 is first threaded onto the arm end to secure each arm to the base portion. Nut 134 is then threaded onto the arm end and tightened against nut 132. In a preferred embodiment, at least two nuts are tightened onto the arm end for purposes that will described in further detail below. More preferably, a like number of nuts greater than or equal to two having similar dimensions are used for securing each arm 116 to the decorative and mounting plates, 118 and 114 respectively.

The opening configuration of plates 114, 118, 140 as described above is merely illustrative. The types of openings that are cut into the plates are in large part determined by the cross-section of the arm ends 126. Those skilled in the art will appreciate that numerous configurations are possible. Moreover, each set of aligned openings in the respective plates need not have like geometry to obtain certain advantages of the invention.

Once the arms are attached to the decorative and mounting plates, the spring plate 140 is fastened. The spring plate openings 148 and central aperture 144 are aligned with the respective arm ends 126 and support rod 120, and inserted onto the assembly. Nut 136 is threaded onto the support rod 120 to secure the spring plate to the base portion. In the case where there are less nuts used to secure the support rod than the arm ends, the spring plate is held by nut 136 in a position level to or slightly below the level of the arm nuts 134, thereby increasing tension of the spring plate against arm ends 126. As shown in FIG. 5, the spring plate 140 includes a flexible portion 142 for each opening 148. As nut 136 is tightened onto the support rod, the respective flexible portion of the spring plate flexibly contacts each arm end 126. The assembly allows rotation of the arms 116 to a position that minimizes packaging volume. Upon installation, the arms are then easily rotated to lockingly engage the flexible portion 142 into a predetermined alignment position. The alignment position is determined by the location of a notch 150 located on the arm end 126. The notch 150 is adapted to receive the flexible portion 142 of the spring plate 140 when the arm is rotated to the predetermined alignment position. As the arm is rotated to the predetermined alignment position, the flexible portion 142 is lockingly engaged in the notch 150 of the arm end 126. It should be appreciated by those skilled in the art in view of this disclosure that different shapes and sizes can be used for the flexible portion of the spring plate and the notch of each arm end.

The flexible portion of the spring plate as shown in FIG. 5, includes a nub 152 that extends into opening 148. As such, when the spring plate 140 is secured to the support rod 120, the nub 152 contacts the arm end 126 and causes the flexible portion to flex against the arm end. The manufacturer can then rotate and position the arms to minimize packaging volume. Upon installation, the installer simply rotates the arm until the arm locks into the predetermined alignment position. Once the nub 152 is engaged with the notch 150, further rotation in either direction is prevented.

Figure 6:
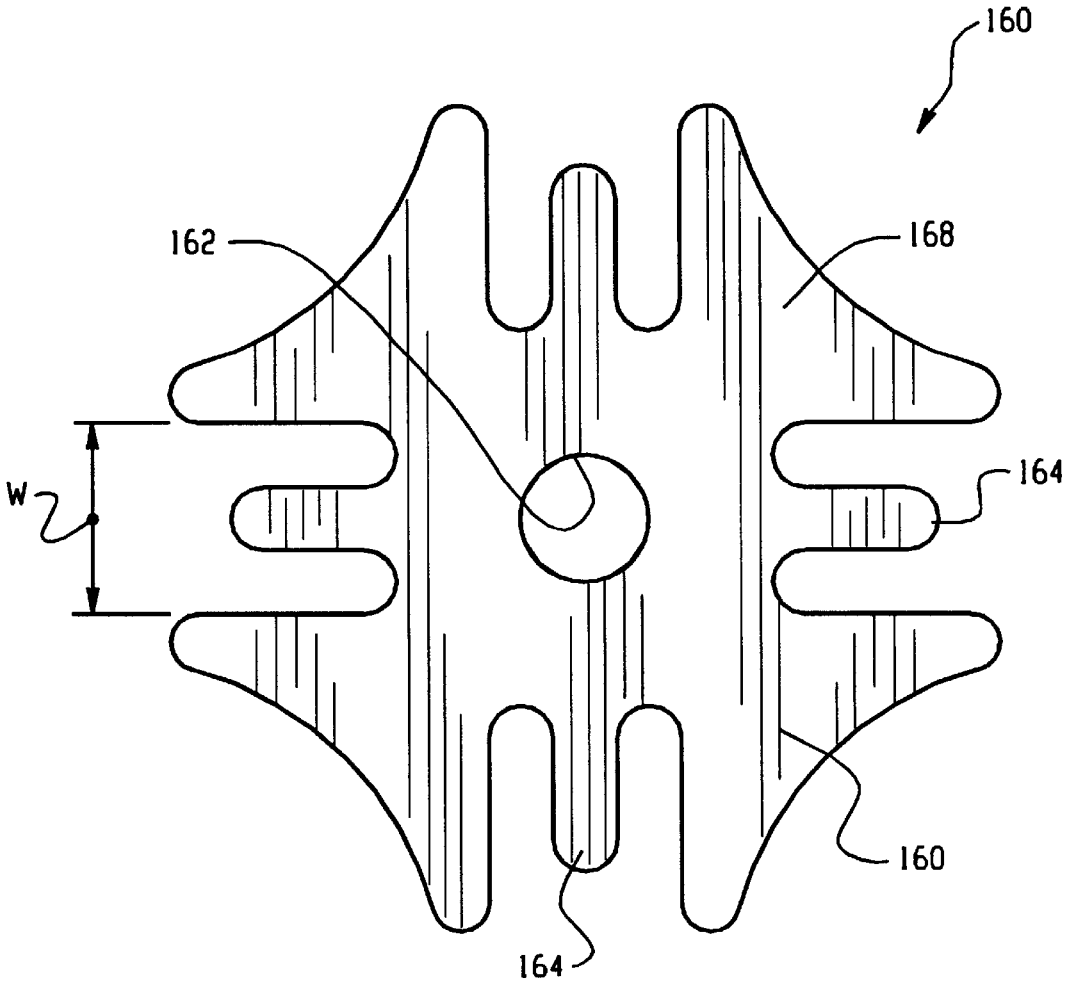
FIG. 6 is a side plan view of a spring plate constructed in accordance with another embodiment of the invention.

In another embodiment, a spring plate 160 suitable for use in the present invention is depicted FIG. 6. The spring plate includes a central aperture 162 and independent flexible portions 164. The spring plate, when fastened to the support rod 120 in the manner described above, will make contact with the arm ends 126 and cause the flexible portions to flex against the corresponding arm end. The notch 150 on each arm end is adapted to lockingly receive the flexible portion 164 of spring plate 160 when the arm is rotated to the predetermined alignment position. The spring plate further includes winged portions 168 that provide stability and structural support to the light fixture assembly. It is not intended that the size and shape of the winged portions to be limited to what is depicted. Those skilled in the art will appreciate that numerous sizes and shapes are possible. During assembly, the central aperture of the spring plate is aligned with and inserted onto the support rod. Adjacent winged portions of the spring plate define a space W that generally corresponds to the diameter of the arm end. Thus, as the spring plate is fastened to the support rod, the space W is aligned with each arm end such that the spring plate is locked between adjacent winged portions. Once assembled, the arms can be rotated to lockingly engage the flexible portions 164 with the arm end notch 150 in a predetermined alignment position.

It is pointed out that rotation of the arms does not cause the arms to loosen. As discussed above, the light fixture assembly 110 includes at least two nuts 132, 134 to secure each arm 116 to the decorative 118 and mounting 114 plates. As a result of the use of at least two nuts, rotating the arms in either direction during installation does not loosen or tighten the nuts. Thus, the use of at least two nuts as shown, allows the user to rotate the arms without affecting the structural integrity.

The foregoing arrangement provides a mechanism for quickly and simply positioning an arm of a light fixture assembly to a predetermined alignment position upon assembly and installation. It also provides a mechanism for positioning the arms of the light fixture so as to allow the light fixture to be configured and assembled in a manner that minimizes the packaging volume occupied by the lamp fixture assembly.

Many modifications and variations of the invention will be apparent to those skilled in the art in light of the foregoing disclosure. Therefore, it is to be understood that, within the scope of the appended claims, the invention can be practiced otherwise than has been specifically shown and described.

What is claimed is:

1. A light fixture assembly having at least one arm that can be preassembled wherein the arm can be adjustably positioned to minimize packaging volume and, during installation, the arm can be adjustably positioned to lockingly engage a predetermined alignment position, the light fixture comprising:

a first plate having a central aperture and at least one peripheral opening;

at least one arm wherein one end of the arm extends through the at least one peripheral opening and is secured to the first plate;

a second plate removed from and fixedly positioned relative to the first plate, the second plate having a central aperture and at least one independently flexible portion in contact with the arm;

a support rod extending through the central apertures and secured to the first plate; and locking means for lockingly engaging the arm in a predetermined alignment position during installation.

2. The light fixture assembly of claim 1 wherein the locking means comprises a notch on the end of the arm adapted to lockingly receive the flexible portion of the second plate when the arm is rotated to the predetermined alignment position.

3. The light fixture assembly of claim 1 wherein the end of each arm is threaded and is secured to the first plate by at least two nuts.

4. The light fixture of claim 1 wherein the support rod is secured to the first plate by at least one nut.

5. The light fixture assembly of claim 1 wherein the end of each arm is threaded and secured to the first plate by at least two nuts and the support rod is threaded and is secured to the first plate by at least one nut.

6. The light fixture assembly of claim 1 wherein the first and second plates are substantially planar.

7. The light fixture assembly of claim 1 wherein the second plate is secured to the support rod with at least one nut whereby the flexible portion flexibly contacts the arm end.

8. The light fixture assembly of claim 1 wherein there are a plurality of arms and a like number of flexible portions in the second plate each in contact when the light fixture is assembled with an associated one of the arm ends.

9. The light fixture assembly of claim 1 wherein the second plate comprises at least one peripheral openings axially aligned with each of the first plate peripheral openings.

10. The light fixture assembly of claim 9 wherein the flexible portion extends into each second plate opening for providing contact with the arm end.

11. A light fixture having at least one arm that can be preassembled wherein the arm can be positioned to minimize packaging volume and during installation can be positioned to lock into a predetermined alignment position, the light fixture comprising:

a mounting plate having opposing substantially planar surfaces and at least one peripheral opening;

a second plate removed from and fixedly positioned relative to the first plate, the second plate having substantially planar surfaces, and peripheral openings axially aligned with each of the first plate peripheral openings, wherein the second plate has an independently flexible portion extending into each opening; and at least one arm having one end extending into the openings of the first and second plates and in contact with the flexible portion of the second plate wherein the end has a notch at a predetermined alignment position for receiving the flexible portion of the second plate such that when the notch is in the predetermined alignment position, the flexible portion of the second plate and notch are lockingly engaged, and when the notch is not in the predetermined alignment position, the arm can be rotated to a position that minimizes a packaging volume of the light fixture assembly.

12. The light fixture assembly of claim 11 wherein each arm is threaded and is secured to the first plate by at least two nuts.

13. The light fixture of claim 11 wherein the support rod is secured to the first plate by at least one nut.

14. The light fixture assembly of claim 11 wherein the second plate is secured to the support rod with at least one nut for flexing the flexible portion against the arm end.

15. In a base for a light fixture assembly having at least one arm extending therefrom, the base including a decorative cover, a mounting plate having an opening for each arm, and a washer and a nut for securing the arm and support rod to the mounting plate wherein the support rod provides means for attachment of the base to the ceiling, the improvement comprising:

at least two nuts to secure each arm to the mounting plate;

a spring plate removed from and fixedly positioned relative to the mounting plate, the spring plate having a central aperture for receiving the support rod and a like number of openings as the mounting plate axially aligned with each of the mounting plate openings; and a nut for securing the spring plate to the support rod.

16. The improvement of claim 15 further comprising an independently flexible portion in the spring plate extending into each spring plate opening and a notch on the end of each arm adapted to lockingly receive the flexible portion when the arm is rotated to a predetermined alignment position.

17. The improvement of claim 15 wherein the mounting plate and second plates are substantially planar.

18. A method of packaging and assembling a light fixture assembly having a plurality of arms said method comprising:

inserting an end of each arm into a peripheral opening of a mounting plate wherein the other end of the arm is connected to a lamp fixture;

fastening each end of the arm to the mounting plate with at least two nuts;

rotating the arms to minimize packaging volume;

fastening a support rod to a central aperture of the mounting plate;

inserting a spring plate having at least one flexible portion corresponding to each arm and a central aperture onto the support rod and in contact with an end of the arm;

fastening the spring plate to the support rod;

flexing the flexible portion of the spring plate against each arm end; and rotating each arm to a desired installation position for installing the light fixture assembly.

19. The method of packaging and assembling of claim 18 further comprising:

lockingly engaging the flexible portion of the spring plate with a notch in each arm end whereby the arms are locked in a predetermined alignment position.

* * * * *